US005544752A

United States Patent [19]

Cox

[11] Patent Number: 5,544,752

[45] Date of Patent: Aug. 13, 1996

[54] EVACUABLE STORAGE BAG

[76] Inventor: Dean M. Cox, P.O. Box 372, Brushton, N.Y. 12916

[21] Appl. No.: 386,315

[22] Filed: Feb. 9, 1995

[51] Int. Cl.[6] ..... B65D 81/20; B65D 33/24

[52] U.S. Cl. ..... 206/524.8; 383/41; 383/63; 383/100

[58] Field of Search ..... 206/522, 524.8; 383/3, 41, 63, 100, 127, 904

[56] References Cited

U.S. PATENT DOCUMENTS

| | | | |
|---|---|---|---|
| 3,958,693 | 5/1976 | Greene | 206/524.8 |
| 4,018,253 | 4/1977 | Kaufman | 206/524.8 |
| 4,576,283 | 3/1986 | Fafournoux | 206/524.8 |
| 5,009,318 | 4/1991 | Lepinoy | 206/524.8 |
| 5,080,155 | 1/1992 | Crozier | 383/63 |
| 5,142,970 | 9/1992 | ErkenBrack | 206/524.8 |
| 5,240,112 | 8/1993 | Newburger | 206/524.8 |
| 5,246,114 | 9/1993 | Underwood | 383/3 |
| 5,332,095 | 7/1994 | Wu | 383/904 |
| 5,339,959 | 8/1994 | Cornwell | 206/524.8 |

FOREIGN PATENT DOCUMENTS

| | | | |
|---|---|---|---|
| 2428587 | 2/1980 | France | 206/524.8 |
| 139351 | 5/1990 | Japan | 206/524.8 |
| 29750 | 2/1991 | Japan | 206/524.8 |
| 4-239447 | 8/1992 | Japan | 206/524.8 |
| 4-242544 | 8/1992 | Japan | 206/524.8 |
| 4-294772 | 10/1992 | Japan | 206/524.8 |

*Primary Examiner*—Jimmy G. Foster

[57] ABSTRACT

A bag for receiving objects and permitting manual evacuation of air from the bag. The inventive device includes a bag within which objects can be positioned. A bag sealing assembly extends across an opening of the bag to seal objects therewithin. A suction assembly extends through the bag and into fluid communication with an interior thereof to permit manual suctioning of air from the bag.

3 Claims, 4 Drawing Sheets

EVACUABLE STORAGE BAG

BACKGROUND OF THE INVENTION

1. Field of the Invention

The present invention relates to plastic bag structures and more particularly pertains to an evacuable storage bag for receiving objects and permitting manual evacuation of air from the bag.

2. Description of the Prior Art

The use of plastic bag structures is known in the prior art. More specifically, plastic bag structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art plastic bag structures include U.S. Pat. No. 4,553,693; U.S. Pat. No. 5,174,469; U.S. Pat. No. 3,524,566; U.S. Pat. No. 3,799,914; and U.S. Pat. No. 4,397,394.

While these devices fulfill their respective, particular objectives and requirements, the aforementioned patents do not disclose an evacuable storage bag for receiving objects and permitting manual evacuation of air from the bag which includes a bag within which objects can be positioned, a bag sealing assembly extending across an opening of the bag to seal objects therewithin, and a suction assembly extending through the bag and into fluid communication with an interior thereof to permit manual suctioning of air from the bag.

In these respects, the evacuable storage bag according to the present invention substantially departs from the conventional concepts and designs of the prior art, and in so doing provides an apparatus primarily developed for the purpose of receiving objects and permitting manual evacuation of air from the bag.

SUMMARY OF THE INVENTION

In view of the foregoing disadvantages inherent in the known types of plastic bag structures now present in the prior art, the present invention provides a new evacuable storage bag construction wherein the same can be utilized for storing objects within a vacuum. As such, the general purpose of the present invention, which will be described subsequently in greater detail, is to provide a new evacuable storage bag apparatus and method which has many of the advantages of the plastic bag structures mentioned heretofore and many novel features that result in a evacuable storage bag which is not anticipated, rendered obvious, suggested, or even implied by any of the prior art plastic bag structures, either alone or in any combination thereof.

To attain this, the present invention generally comprises bag for receiving objects and permitting manual evacuation of air from the bag. The inventive device includes a bag within which objects can be positioned. A bag sealing assembly extends across an opening of the bag to seal objects therewithin. A suction assembly extends through the bag and into fluid communication with an interior thereof to permit manual suctioning of air from the bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new evacuable storage bag apparatus and method which has many of the advantages of the plastic bag structures mentioned heretofore and many novel features that result in a evacuable storage bag which is not anticipated, rendered obvious, suggested, or even implied by any of the prior art plastic bag structures, either alone or in any combination thereof.

It is another object of the present invention to provide a new evacuable storage bag which may be easily and efficiently manufactured and marketed.

It is a further object of the present invention to provide a new evacuable storage bag which is of a durable and reliable construction.

An even further object of the present invention is to provide a new evacuable storage bag which is susceptible of a low cost of manufacture with regard to both materials and labor, and which accordingly is then susceptible of low prices of sale to the consuming public, thereby making such evacuable storage bags economically available to the buying public.

Still yet another object of the present invention is to provide a new evacuable storage bag which provides in the apparatuses and methods of the prior art some of the advantages thereof, while simultaneously overcoming some of the disadvantages normally associated therewith.

Still another object of the present invention is to provide a new evacuable storage bag for receiving objects and permitting manual evacuation of air from the bag.

Yet another object of the present invention is to provide a new evacuable storage bag which includes a bag within which objects can be positioned, a bag sealing assembly extending across an opening of the bag to seal objects therewithin, and a suction assembly extending through the bag and into fluid communication with an interior thereof to permit manual suctioning of air from the bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
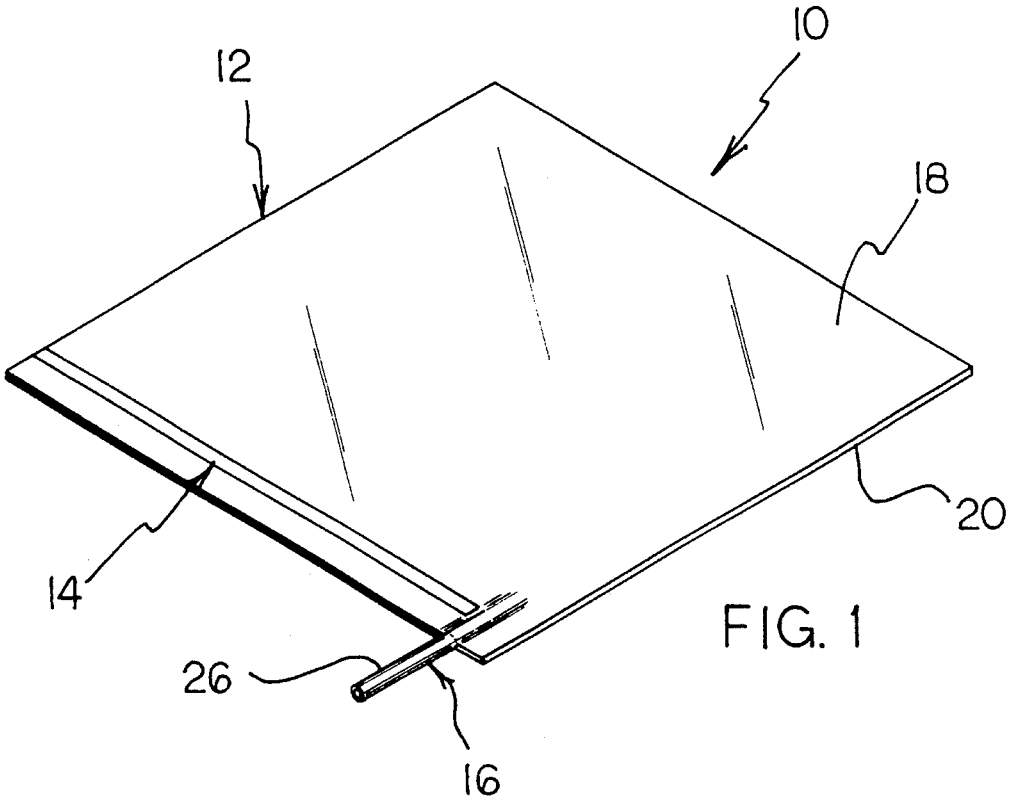
FIG. 1 is an isometric illustration of an evacuable storage bag according to the present invention.

With reference now to the drawings, and in particular to FIGS. 1–8 thereof, a new evacuable storage bag embodying the principles and concepts of the present invention and generally designated by the reference numeral 10 will be described.

Figure 8:
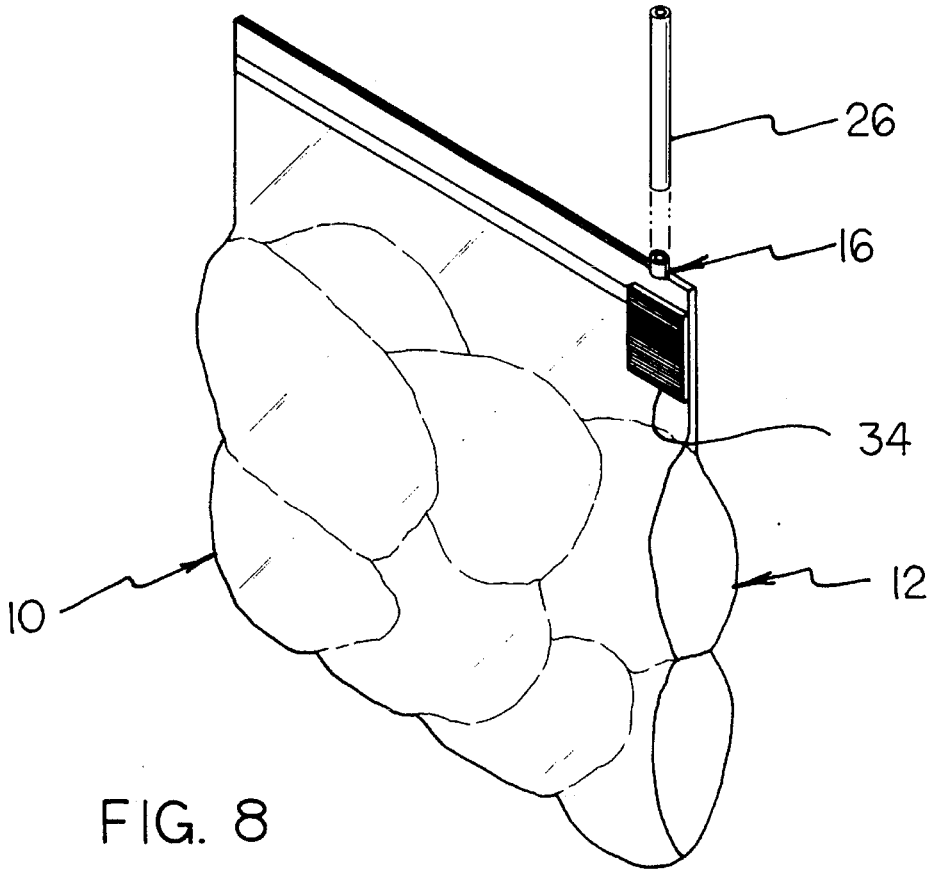
FIG. 8 is an isometric illustration of the present invention in use.

More specifically, it will be noted that the evacuable storage bag 10 comprises a bag means 12 for receiving and storing objects therewithin. A bag sealing means 14 extends across an open end of the bag means 12 for selectively and releasably sealing closed the open end of the bag means. A suction means 16 extends into fluid communication with an interior of the bag means 12 for permitting manual evacuation of air from the bag means to store such objects within the bag as shown in FIG. 8 of the drawings.

As best illustrated in FIG, 1 and 2, it can be shown that the bag means 12 according to the present invention 10 preferably comprises a flexible upper panel 18 coupled to a flexible lower panel 20 along outer peripheral edges thereof so as to define an expansible space between the upper and lower panels. The panels 18 and 20 can be of any desired shaped and are illustrated within the drawings as being substantially square in shape. The panels 18 and 20 are preferably formed of a substantially translucent or transparent polymeric material. The upper panel 18 is secured to the lower panel 20 along an outer edge thereof and uncoupled relative to the lower panel 20 along a forward edge thereof to define an unlabeled opening within which objects can be placed into the bag means 12. By this structure, objects can be placed between the upper panel 18 and the lower panel 20 so as to reside within an interior of the bag means 12.

Figure 2:
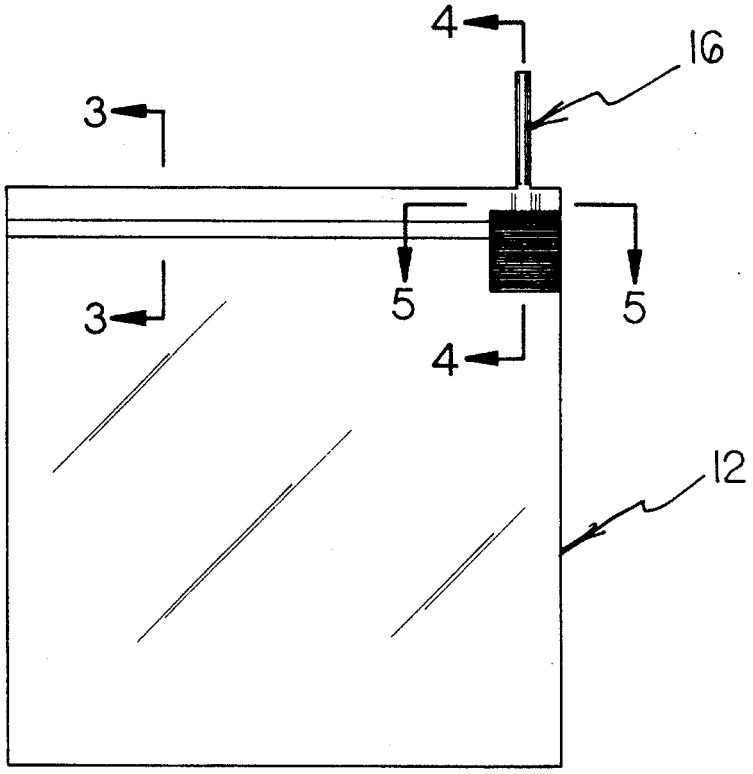
FIG. 2 is a front elevation view thereof.
Figure 3:
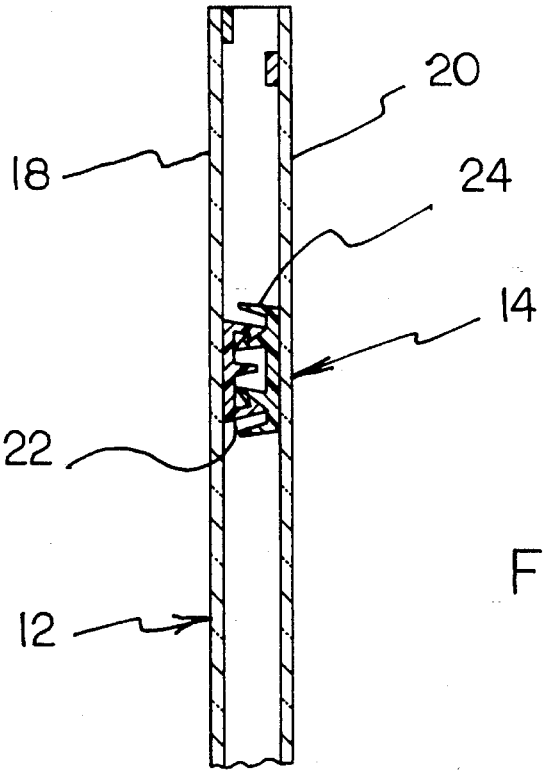
FIG. 3 is a cross sectional view taken along line 3—3 of FIG. 2.
Figure 4:
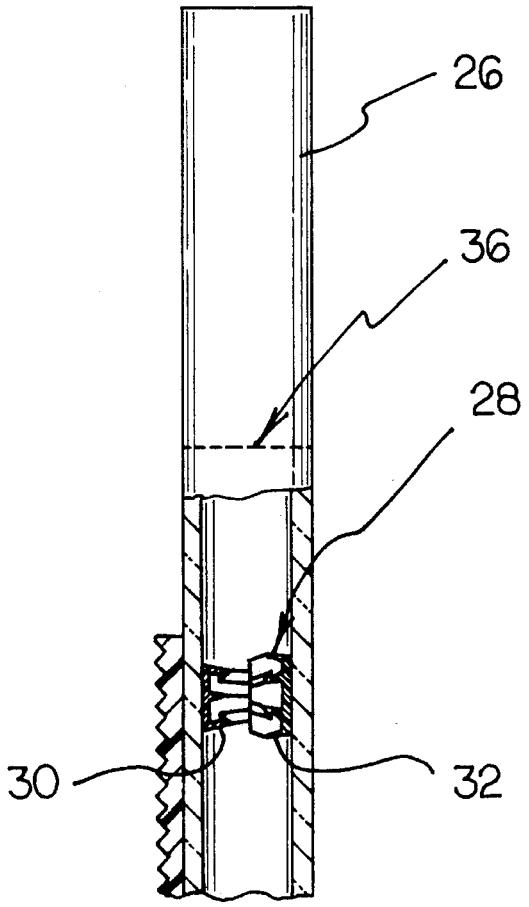
FIG. 4 is a cross sectional view taken along line 4—4 FIG. 2.

As best illustrated in FIGS. 1 through 3, it can be shown that the bag sealing means 14 according to the present invention 10 preferably comprises a first bag sealing strip 22 coupled to an interior surface of the upper panel 18. Similarly, a second bag sealing strip 24 is coupled to an interior surface of the lower panel 20 and positioned for engagement with the first bag sealing strip 22 as shown in FIG. 3. The bag sealing strips 22 and 24 are cooperable so as to form a fluid tight seal across the opening of the bag means 12. By this structure, objects placed within the bag means 12 can be sealed therewithin by a closure of the bag sealing means 14 accomplished through an engagement of the sealing strips 22 and 24 together into the configuration shown in FIG. 3.

Figure 5:
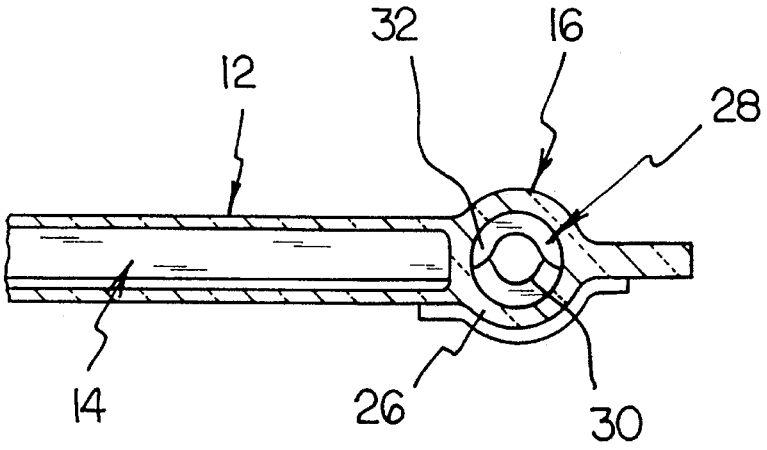
FIG. 5 is a cross sectional view taken along line 5—5 of FIG. 2.
Figure 6:
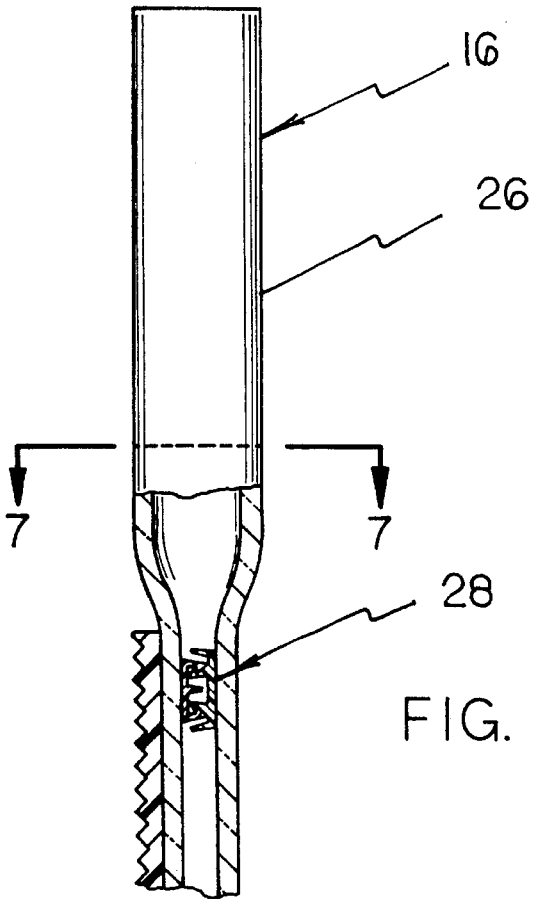
FIG. 6 is a cross sectional view of a conduit sealing means in a sealed configuration.

As best illustrated in FIGS. 4 through 7, it can be shown that the suction means 16 according to the present invention 10 preferably comprises a conduit 26 directed through the bag means 12 and into fluid communication with an interior of the bag means. The conduit 26 is operable to be connected to a source of vacuum, such as an individual's mouth during inhalation to effect suctioning of air from the bag means 12. To retain a vacuum within the interior of the bag means 12 subsequent to suctioning of air therefrom, the suction means 16 further comprises a conduit sealing means 28 positioned within the conduit 26 for selectively precluding fluid communication therethrough. To this end, the conduit sealing means 28 comprises a first conduit sealing strip 30 extending along a first interior surface of the conduit 26 and a second conduit sealing strip 32 extending along a second interior surface of the conduit 26 and positioned for cooperative engagement with the first conduit sealing strip 30. By this structure, the conduit sealing strips 30 and 32 of the conduit sealing means 28 are normally maintained in an open position as illustrated in FIG. 5 due to the circular cross section of the conduit 26. However, after suctioning of air from the bag as illustrated in FIG. 8, pressure can be applied to an exterior of the conduit 26 to effect collapsing thereof and cooperative engagement of the first conduit sealing strip 30 with the second conduit sealing strip 32 to join the conduit sealing strips together as shown in FIG. 6 to preclude fluid communication through the conduit 26. By this structure, a negative pressure or vacuum is maintained within the bag means 12 to facilitate prolong storage of the objects contained therewithin. To assist in closure or collapsing of the conduit 26 during coupling of the first conduit sealing strip 30 to the second conduit sealing strip 32, a rough-surfaced gripping pad 34 is desirably secured to an exterior of the conduit 26 proximal to the conduit sealing strips 30 and 32 positioned therewithin.

Figure 7:
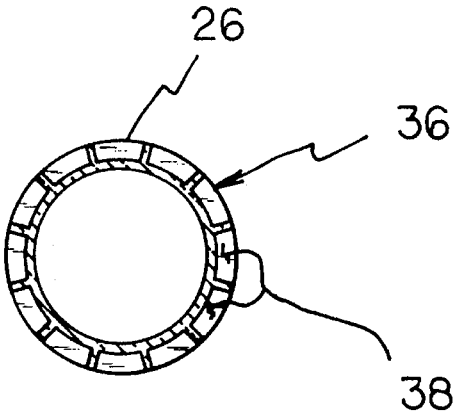
FIG. 7 is a cross sectional view taken along line 7—7 of FIG. 6.

Subsequent to evacuation of air from the bag means 12 and closure of the conduit sealing means 28, it is desirable to shorten the conduit 26 for storage of the device 10. To this end, the conduit 26 may further comprise a frangible means 36 extending thereabout for permitting selective fracturing of a portion of the conduit. To this end, and as shown in FIG. 7, the frangible means 36 comprises a plurality of radially extending perforations 38 directed only partially into an exterior surface of the conduit 26. It is important to note that the perforations 38 can not extend through the conduit 26 inasmuch as such through-extending perforations would preclude vacuuming of air from the bag means 12. The perforations 38 thus cooperative to define a weakened area from which a portion of the conduit 26 can be separated as shown in the isometric illustration of FIG. 8.

In use, the evacuable storage bag 10 according to the present invention can be easily utilized to store objects in a state of vacuum, whereby such objects are able to be maintained for longer periods of time. The present invention is particularly suited for storage of perishable or other food goods.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An evacuable storage bag comprising:

a bag means having a flexible upper panel; a flexible lower panel coupled to the flexible upper panel along outer peripheral edges thereof so as to define an expansible space between the upper and lower panels, the panels being uncoupled relative to one another along a forward edge thereof to define an opening through which objects can be placed into the bag means;

a bag sealing means extending across an open end of the bag means comprising a first bag sealing strip coupled to an interior surface of the upper panel; and a second bag sealing strip coupled to an interior surface of the lower panel and positioned for engagement with the first bag sealing strip;

a suction means comprising a conduit directed through the bag means and into fluid communication with an interior of the bag means; and a conduit sealing means positioned within the conduit, said sealing means comprising a first conduit sealing strip extending along a first interior surface of the conduit and a second conduit sealing strip extending along a second interior surface of the conduit and positioned for cooperative engagement with the first conduit sealing strip wherein pressure applied to an exterior of the conduit will effect collapsing thereof and cooperative engagement of the conduit sealing strips to preclude fluid communication through the conduit;

a gripping pad coupled to an exterior of the conduit proximal to the conduit sealing strips positioned therewithin;

and, wherein the conduit further comprises a frangible means extending thereabout for permitting selective fracturing of a portion of the conduit.

2. The evacuable storage bag of claim 1, wherein the frangible means comprises a plurality of radially extending perforations directed only partially into an exterior surface of the conduit.

3. The evacuable storage bag of claim 1, and further comprising an independent rough-surfaced gripping pad secured to an exterior of the conduit proximal to the conduit sealing strips positioned therewithin.

* * * * *